US008444430B2

(12) United States Patent
Kappla et al.

(10) Patent No.: US 8,444,430 B2
(45) Date of Patent: May 21, 2013

(54) CONNECTOR ELEMENT CONTAINING A LOCKING MECHANISM

(75) Inventors: Olaf Kappla, München (DE); Katja Schöber, Baldham (DE); Andreas Schmid, Grünwald (DE); Norbert Niesemeyer, Coburg (DE)

(73) Assignee: Leoni Kabel Holding GmbH, Nuremburg (DE)

( * ) Notice: Subject to any disclaimer, the term of this patent is extended or adjusted under 35 U.S.C. 154(b) by 0 days.

(21) Appl. No.: 13/527,129

(22) Filed: Jun. 19, 2012

(65) Prior Publication Data

US 2012/0294571 A1 Nov. 22, 2012

Related U.S. Application Data

(63) Continuation of application No. PCT/EP2010/007738, filed on Dec. 18, 2010.

(30) Foreign Application Priority Data

Dec. 19, 2009 (DE) ..... 10 2009 059 685

(51) Int. Cl.
*H01R 13/627* (2006.01)

(52) U.S. Cl.
USPC ..... 439/352; 439/484

(58) Field of Classification Search
USPC ..... 439/352, 483, 357, 607.41
See application file for complete search history.

(56) References Cited

U.S. PATENT DOCUMENTS

| | | | | |
|---|---|---|---|---|
| 5,716,049 | A * | 2/1998 | Pundzus et al. | 273/118 R |
| 7,134,914 | B1 * | 11/2006 | Wu | 439/607.41 |
| 7,281,937 | B2 | 10/2007 | Reed et al. | |
| 7,476,117 | B1 | 1/2009 | Chen et al. | |
| 7,540,755 | B1 | 6/2009 | Wu | |
| 7,736,171 | B2 | 6/2010 | Reed et al. | |
| 7,938,669 | B2 * | 5/2011 | Li et al. | 439/352 |
| 8,251,735 | B2 * | 8/2012 | Wu | 439/353 |
| 8,267,713 | B2 * | 9/2012 | Wu | 439/352 |

FOREIGN PATENT DOCUMENTS

WO 2006/091256 A1 8/2006

OTHER PUBLICATIONS

International Search Report of PCT/EP2010/007738, Mar. 16, 2011.

* cited by examiner

*Primary Examiner* — Hae Moon Hyeon
(74) *Attorney, Agent, or Firm* — Laurence A. Greenberg; Werner H. Stemer; Ralph E. Locher

(57) ABSTRACT

A plug element, in particular a so-called small form-factor pluggable connector, has a reliable, effective and easily mountable locking mechanism. To accomplish this, an arrangement of a locking element and an actuating element inside of a housing of the connector element is provided. The locking element contains a detent element for latching and locking with a mating piece, into which the connector element can be inserted to form a lockable plug connection. The actuating element contains a grip part, which is guided through a first opening through the housing to the outside.

14 Claims, 7 Drawing Sheets

CONNECTOR ELEMENT CONTAINING A LOCKING MECHANISM

CROSS-REFERENCE TO RELATED APPLICATION

This application is a continuation, under 35 U.S.C. §120, of copending international application No. PCT/EP2010/007738, filed Dec. 18, 2010, which designated the United States; this application also claims the priority, under 35 U.S.C. §119, of German patent application No. DE 10 2009 059 685.2, filed Dec. 19, 2009; the prior applications are herewith incorporated by reference in their entirety.

BACKGROUND OF THE INVENTION

Field of the Invention

The invention relates to a connector element. A connector element of this type is disclosed, for example, in international patent disclosure WO 2006/091256 A1, corresponding to U.S. Pat. Nos. 7,281,937 and 7,736,171.

The connector element is in particular configured as a flat connector with a usually rectangular cross-section and a low structural height. A connector element is therefore in this case to be understood in particular to be a so-called small form-factor pluggable connector, specifically a so-called CXP low-profile connector.

The connector element is also configured especially as a so-called CXP connector element, as specified for example in the "Supplement to InfiniBand Architecture Specification, Vol. 2, Rel. 1.2.1, Annex A6: 120 Gb/s 12x Small Form-Factor Pluggable (CXP), Version 0.90—May 13, 2009" published by the InfiniBand Trade Association, or as specified for example in "SFF 8642 specification for mini multi-lane series: shielded integrated connector, Rev. 2.0, Jul. 2, 2009" published by the Small Form-Factor (SFF).

Connector elements of this type are used to form compact and flat plug connections for data or signal cables with high data transmission rates in networks. They are used to electrically and/or optically connect the data cable to electrical or electro-optical appliances. They thus preferably serve to join the data cable to a circuit board. The circuit board hereby normally has a mating piece which is configured in particular as a mating plug-in element into which the connector element can be plugged in order to form the plug connection.

It is hereby intended to produce a structure that is as compact as possible in order to arrange, for example, several such plug-in connectors next to one another on a limited structural space.

Plug connections of this type are usually protected from being unintentionally detached by a locking mechanism. Because of the desired compact structure, the locking mechanism must be integrated into the connector element within a very narrow structural space.

In the configuration disclosed in international patent disclosure WO 2006/091256 A1, the locking mechanism contains an actuating element configured as a pull tab which can be displaced in a groove on the outside of the housing, in the longitudinal direction of the connector element. The pull tab is sandwiched between the outside of the housing and a more or less T-shaped locking element. The locking element has at its front end a latching element bent downwards which is used for locking to the mating piece. At the same time, the actuating element has at its front end a barrel-like part which is arranged between an obliquely extending part of the top of the housing and the downwardly angled latching element of the locking element. When the actuating element is displaced rearwards, the barrel-like part slides along the obliquely inclined housing part and pushes the latching element upwards into an unlocking position.

SUMMARY OF THE INVENTION

It is accordingly an object of the invention to provide a connector element which overcomes the above-mentioned disadvantages of the prior art devices of this general type, which has an improved locking mechanism that can be assembled simply.

The connector element has a housing that extends in the longitudinal direction and a locking element having a latching element for latching to a mating piece. The connector element for actuating the locking element also has an actuating element which has a handle part via which the actuating element can be actuated by hand. Both the actuating element and the locking element are arranged at least in subregions inside the housing, and the housing has a first aperture for the actuating element, the handle part being accessible from outside the housing.

The particular advantage of this embodiment is that the locking mechanism is arranged at least essentially in subregions inside the housing and is thereby protected. The actuating element and the locking element interact functionally in a protected fashion inside the housing. Because of the internal arrangement, the handling of the actuating element is not hindered by, for example, dust or other particles of dirt. There is also no risk of the elements of the locking mechanism being damaged by improper external intervention. The integration inside the housing also allows simplified fastening of the locking mechanism. This is preferably effected exclusively by the formation of rear grips and positive connections such as, for example, rivets or latches, for connecting the components to the housing, without the need for screws, adhesive, etc.

The actuating element can preferably be displaced in the longitudinal direction inside the housing and is hereby configured in particular as a pull tab. The actuating element hereby preferably interacts with the locking element in such a way that the latching element that ultimately effects the locking is moved upwards or downwards and so at least substantially perpendicular to the longitudinal direction, i.e. perpendicular to a base side of the flat connector. Usually when the pull tab is actuated, the latching element is transferred from a base position, corresponding to a locking position, into an unlocking position.

According to an expedient development, the connector housing contains a second aperture through which an outer portion of the locking element, which has the latching element, is guided to the outside. As a result of this measure it is advantageously achieved that the actuating mechanism, namely the interaction between the actuating element and the locking element, is arranged in a protected fashion inside the housing, but that at the same time the fundamental geometrical structure of the connector element and the plug connection exists in accordance with the above-described specifications (SFF 8642 specification and/or CXP specification from the InfiniBand Trade Association). It is namely provided thereby that the latching element engages into the mating piece from above.

The actuating element and the locking element expediently interact via at least one pair of counteracting surfaces. The pair of surfaces hereby has counteracting surfaces that correspond with each other and which are displaced against each other when the actuating element is actuated. The counteracting surfaces are hereby configured so that they are inclined and for example curved with respect to the longitudinal direction or the direction of actuation, so that a resulting movement of the locking element, in particular the latching element, upwards or downwards is achieved by the interaction of the pair of surfaces.

According to a preferred embodiment, the locking element is mounted in the housing so that it can rotate about a preferably horizontal axis of rotation. The displacement of the pull tab in the longitudinal direction results in a rotational movement of the locking element so that the latching element which is configured preferably at the end of the locking element is transferred along a curved or circular path from the base position upwards into the unlocking position. Because of the rotational movement, relatively large adjusting movements of the latching element can be configured with only a small amount of space required. The locking element thus extends preferably over the entire width of the housing and is preferably configured as a flat plate-like component which in particular rests on the base of the housing.

The locking element is expediently rotatably mounted in the housing, in particular in side walls, in particular with the aid of lateral latching pins. The latching pins therefore have a dual function. Firstly, they serve to fasten the locking mechanism simply in the housing, and secondly they simultaneously define the axis of rotation.

The locking element preferably also has a spring element which pushes the locking element as a whole into a base position and is preferably configured as an elastic tab (spring tongue). The spring element thus exerts a spring force on the locking element so that the latter is reliably and securely held in the locking position. The spring element is hereby supported in particular on a counter bearing and the opposing forces are transmitted to the housing. The spring element is preferably supported directly on a base of the housing.

According to an expedient development, the locking element has at least one opening or recess, into which the actuating element engages with an actuating knob. The recess and the actuating knob hereby interact via the counteracting surfaces which correspond with each other. The counteracting surfaces are hereby expediently configured so that they are inclined with respect to the longitudinal direction and can be configured as planes or also as curved surfaces. They are preferably configured in the form of cylindrical surfaces. A compact structure is enabled by arranging recesses inside the locking element, which in particular is flat and plate-like in design, as the counteracting surfaces which correspond with each other are arranged within the structural height of the locking element. As an alternative to configuring the counteracting surface as an internal surface of the recess, the counteracting surface is configured on the edge of the locking element. Two openings of this type are preferably provided, arranged opposite each other on the edge. The spring element is thus preferably arranged centrally between the openings.

According to a preferred development, the actuating element contains a stepped region which is arranged in particular at the end and opposite the handle element and has at least one actuating knob. The stepped region at the end of the actuating element covers the locking element and hence that inner portion of the locking element situated inside the housing. A free space, inside which the locking element is situated, is formed by the stepped arrangement. The reciprocal action between the actuating element and the locking element is also effected in the stepped region via the counteracting surfaces which correspond with each other. The stepped region and a further region of the actuating element which adjoins the former in the longitudinal direction and is oriented towards the handle element are expediently supported on opposing abutments, for example a housing base and an intermediate base, in order to be able to transmit sufficient reaction forces onto the locking element when the actuating element is actuated. The abutments therefore form guide elements, in particular guide surfaces for guiding the actuating element with as little play as possible. It is expediently provided that the height of the step corresponds to approximately the thickness of the locking element or is a little greater than it, in order to permit the movement of the locking element.

To make manufacturing as simple as possible and also for simple assembly, the locking element is formed from a single piece and is in particular configured as a plastic element (injection molded). The locking element is in particular connected to the housing only by the latching pins.

As a whole, the locking element is preferably divided into an inner portion situated inside the housing and an outer portion that projects outwards through the second aperture in the housing. The locking element is preferably configured as a flat, more or less plate-like component. The inner portion hereby has a more or less U-shaped support part which therefore has two arms joined by a base part and at the ends of which latching pins are provided. The spring element is also preferably integrally formed on the base part, approximately in the center. It is also preferably provided that the recesses with the counteracting surfaces are configured on both sides of the spring element. To do so, ribs are additionally provided which connect the side arms to the base part and so form the recesses with the preferably cylindrical counteracting surfaces.

To achieve a compact design while simultaneously allowing the movement of the locking element, it is preferable that the width of the actuating element in the region of the actuating knobs is smaller than the width of the locking element, and that the arms of the support part are guided along the sides of the actuating element, between the latter and side walls of the housing. The arms hereby extend in particular as far as the axis of rotation and therefore define pivoting arms which are thus not hindered in their movement by the actuating element.

In order to reliably guarantee secure guidance and transmission of the forces between the actuating element and the locking element, in a preferred embodiment a counter bearing is provided in the housing, the locking element and the actuating element being arranged between a housing base and the counter bearing. The counter bearing is hereby configured in particular as a separate intermediate base which is fastened to the housing so that an independent separate internal space of the housing is created, in which preferably only the locking element and the actuating element are guided and held. The locking mechanism is thus sealed off from the other functional parts of the connector, i.e. the electrical and/or optical components such as, for example, contact sockets or contact pins.

In a preferred embodiment, the intermediate base therefore forms a mechanical protection and/or a contact protection. For this purpose, the intermediate base preferably completely covers the housing base in the region of the locking mechanism and is therefore situated inside it so that if fits exactly.

The intermediate base is expediently firmly fixed in the housing. To do this, it is in particular riveted or latched inside the housing.

To improve the shielding, the intermediate base is preferably configured to be conductive and is made in particular from metal. It is preferably riveted via rivet elements and/or latched via latching elements to the housing. Other fastening means are not provided.

For secure handling of the actuating element, at least one stop for limiting the movement of the actuating element is preferably also provided. This takes, for example, the form of one or more stop elements that are integrally formed on the housing. According to a preferred embodiment, the stop is formed on the intermediate base. The stop in particular has a step that interacts with the step formed on the actuating element.

As already explained, the connector element preferably complies with the specifications for Small Form-Factor Pluggable (SFP) connectors, in particular the SFF 8642 specification or the abovementioned InfiniBand specification. In a corresponding fashion, the housing has a rear housing part which adjoins a front stepped plug-in part, forming a step. The plug-in part can be plugged into a mating piece which is preferably arranged on a circuit board. The second aperture, through which the outer portion of the locking element is guided, from the inside of the housing to the outside, is expediently formed on the end side, formed by the step, of the rear housing part. To unlock the connector, the locking element is displaced upwards so that it is thus raised by the top of the housing of the front stepped plug-in part. In order to lock the mating piece, the locking element thus engages into corresponding latching receptacles from above with the latching element.

Other features which are considered as characteristic for the invention are set forth in the appended claims.

Although the invention is illustrated and described herein as embodied in a connector element containing a locking mechanism, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
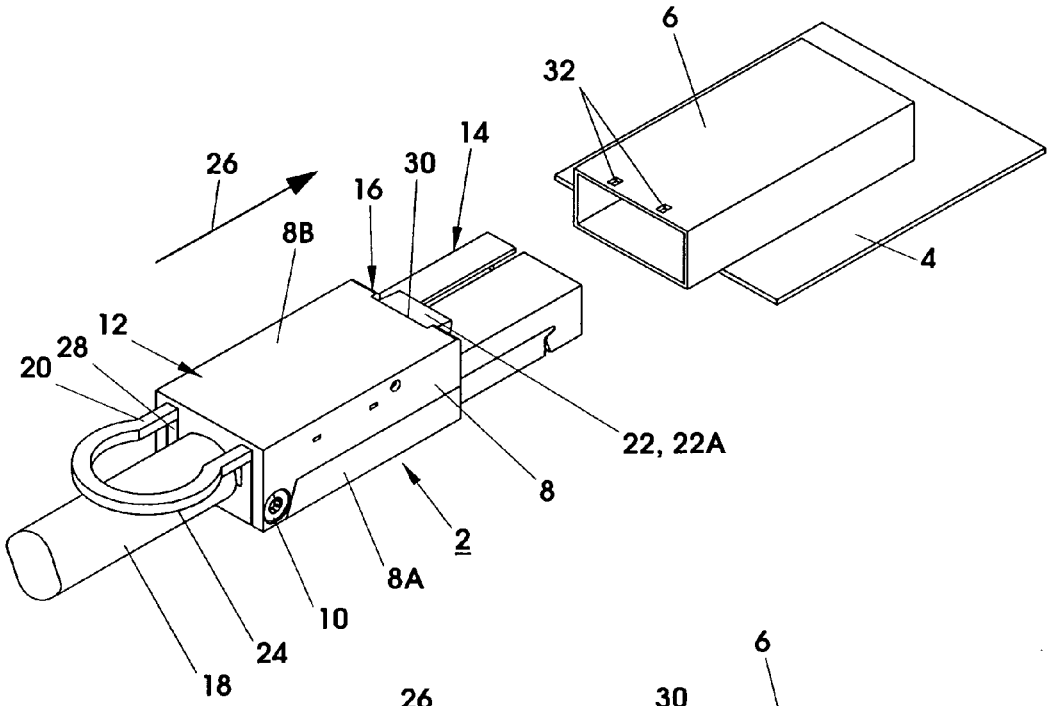
FIG. 1 is a diagrammatic, perspective view of a connector element with an attached cable and a mating piece arranged on a circuit board, with the plug connection separated, according to the invention.

Parts with the same function have the same reference symbols in the drawings. Referring now to the figures of the drawing in detail and first, particularly, to FIG. 1 thereof, there is shown a connector element 2 configured as a flat connector, namely in particular a so-called small form-factor pluggable connector which is configured for high-speed (electrical or optical) data transmission. The connector element 2 serves in particular for plugging into a mating part 6 which is preferably configured as a mating plug-in element and is arranged directly on a circuit board 4.

The connector element 2 here is a compact one which usually has a rectangular cross-sectional geometry when viewed in cross-section. It is typically a few centimeters wide, for example between 2 and 3 cm. Its height or thickness is less than that and is for example between 1.5 and 2 cm. The total length of the connector element 2 (housing less a protruding handle part of the pull tab) is, for example, between 6 and 10 cm.

The connector element 2 shown in the drawings is shown without optical/electrical functional parts, via which the actual electrical or optical connection is made. Only the components required for the locking mechanism are shown.

Figure 2:
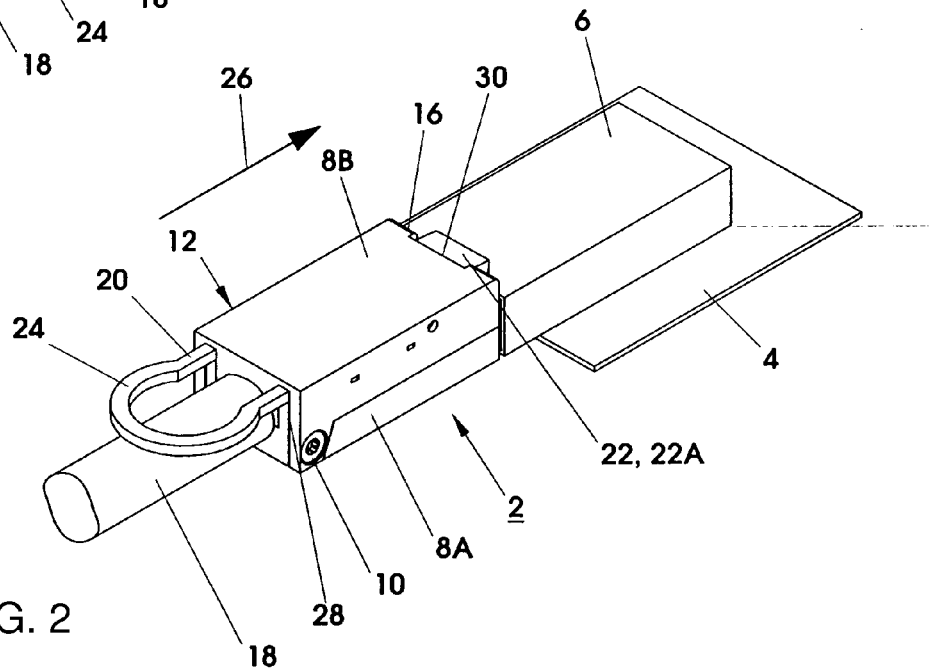
FIG. 2 is a perspective view showing the elements shown in FIG. 1 in the plugged-together position.

According to FIGS. 1 and 2, the connector element 2 serves for plugging into the mating piece 6 arranged directly on the circuit board 4. The connector element 2 can be locked to the mating piece 6 in order to prevent the plug connection becoming unintentionally detached. For this purpose, a locking mechanism is provided which will be described in detail below. Electrical/optical (plug-in) contact elements, for example in the form of sockets and pins, are arranged both in the connector element 2 and in the mating piece 6 in order to form the plug connection, but are not shown in the drawings for the sake of simplicity.

The connector element 2 has a housing 8 with a bottom housing part 8A and a top housing part 8B which are detachably connected to each other. In the exemplary embodiment, laterally arranged screws 10 are provided for this purpose. The housing 8 is divided into a rear housing part 12 and a front housing part which forms a plug-in part 14. The connector element 2 is plugged into the mating piece 6 by the plug-in part 14. In comparison with the rear housing part 12, the plug-in part 14 is stepped with the formation of a step 16. A cable, in particular a data cable 18, is introduced into the housing 8 at a rear side of the housing 8 and, inside the housing 8, contacts the contact elements in a manner not shown in detail. In order to improve the shielding, a shielding shroud which is placed over the end of the connector element and bears against the step is preferably provided in the region of the step 16. In the assembled state, the mating piece 6 engages around the preferably rectangular shielding shroud.

A locking mechanism is also integrated inside the housing 8, namely in the rear housing part 12. It contains an actuating element, configured as a pull tab 20, and a locking element 22. At its rear end, the pull tab 20 has a handle part 24 by which it can be displaced by hand in a longitudinal direction 26 of the connector element 2. The handle part 24 can be actuated by hand from outside the housing 8. The housing 8 therefore has on its rear end side first apertures 28 for the passage of the pull tab 20.

A second aperture 30, through which an outer portion 22A of the locking element 22 is passed, is provided on the front end side of the rear housing part 12 in the region of the step 16. In order to lock it to the mating piece 6, it latches from above into corresponding latching receptacles 32 of the mating piece 6.

Figure 3:
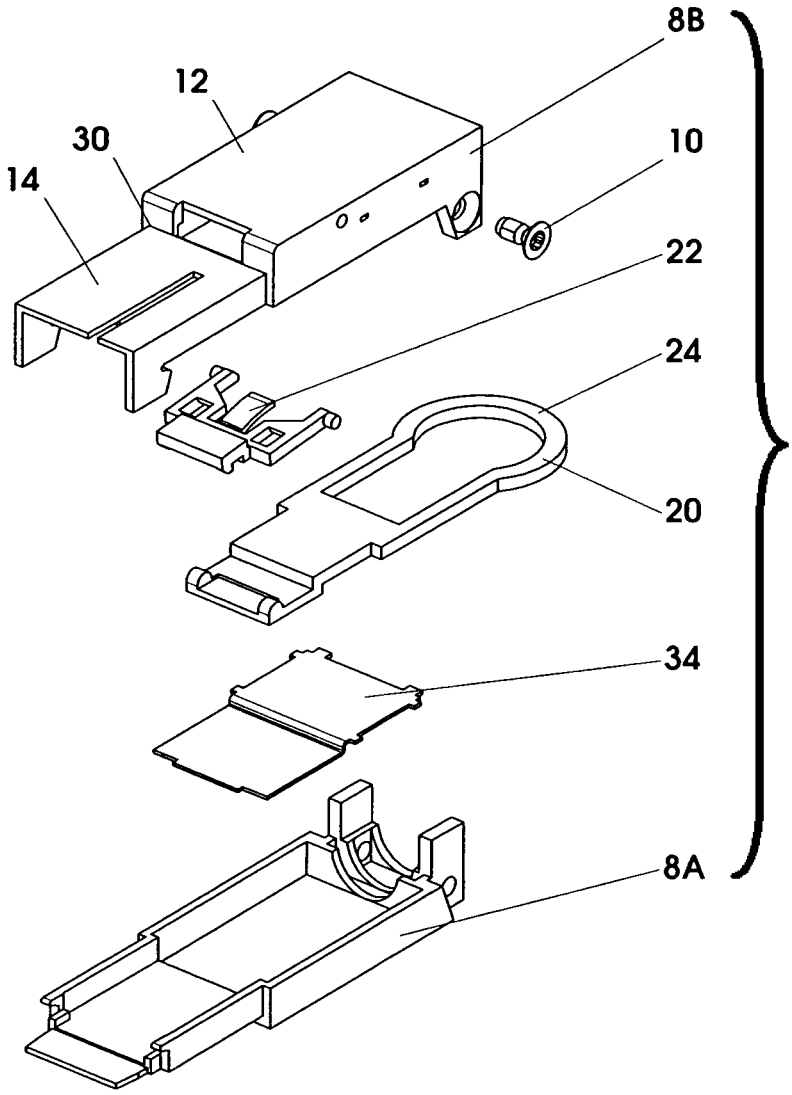
FIG. 3 is an exploded, perspective view of the components provided for a locking mechanism.

As can be seen in the exploded view in FIG. 3, a fixing plate forming an additional intermediate base 34 is provided as a further component for the locking mechanism. The special design of the individual components of the locking mechanism and the assembly of the components is explained in detail with the aid of FIGS. 4A to 4D and FIGS. 7A to 7D, FIGS. 4A to 4D showing a first alternative embodiment and FIGS. 7A to 7D a second alternative embodiment.

Figure 4A:
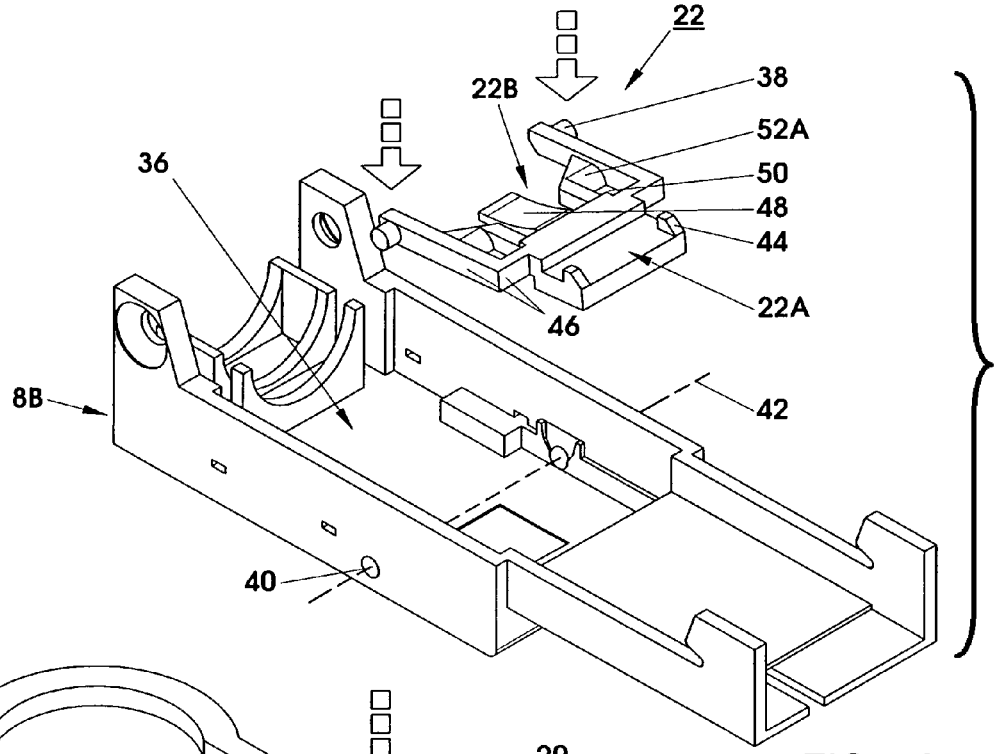
FIGS. 4A to 4D are perspective views for explaining a sequence for assembling the components shown in FIG. 3.
Figure 7A:
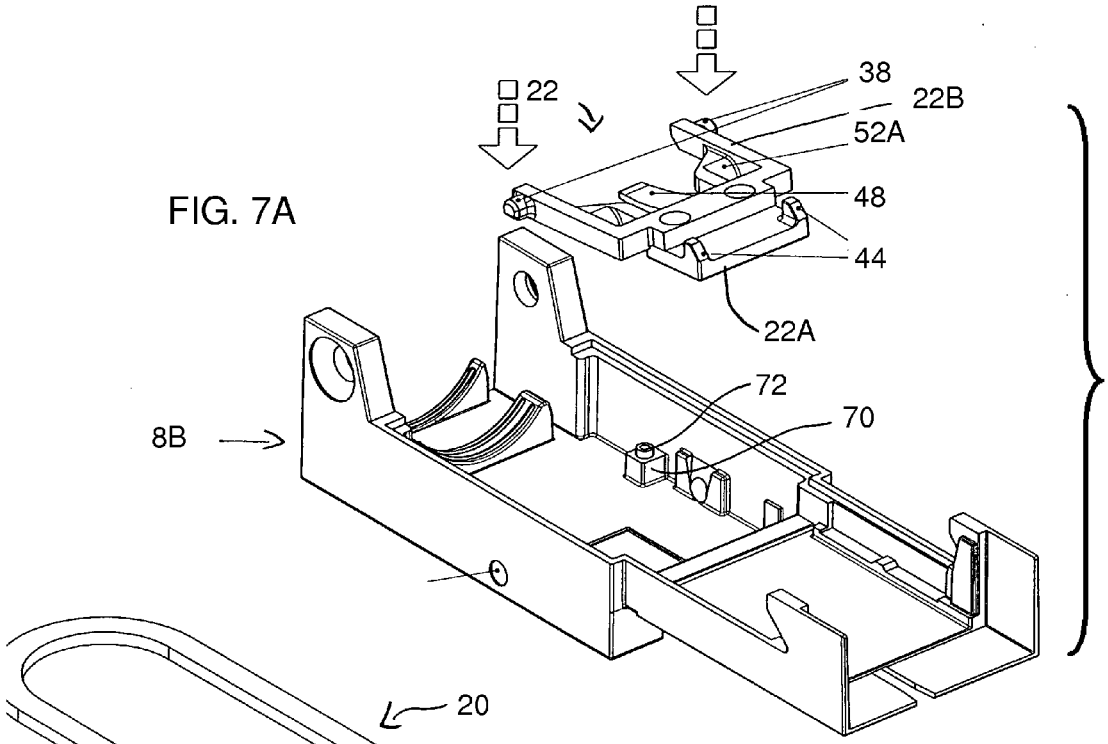
FIGS. 7A to 7D are perspective views of a second alternative embodiment, corresponding to FIGS. 4A to 4D.

In the first assembly step shown in FIGS. 4A and 7A, the locking element 22 is inserted into the top housing part 8B. It is hereby inlaid on a housing base 36 of the top housing part 8B in the region of the second aperture 30 (not visible here), the outer portion 22A of the locking element 22 being guided to the outside through the second aperture 30. For fastening to the housing, the locking element 22 has two laterally protruding latching pins 38 that engage in corresponding receptacles 40 in the side walls of the top housing part 8B. This forms the sole connection to the housing 8. An axis of rotation 42, about which the locking element 22 can rotate inside the housing 8 over a certain range, is formed by the latching pins 38.

In the first alternative embodiment according to FIGS. 4A to 4D, the locking element 22 is configured overall as a one-piece flat component that extends substantially within a plane, and is preferably an injection-molded plastic part. It contains an inner portion 22B, situated inside the rear housing part 12 in the final assembled position, and the above-mentioned outer portion 22A. The outer portion 22A has two lateral spaced-apart latching elements 44 on its front side. The inner portion 22B has a more or less U-shaped support part 46 that contains two arms at its edges and a transverse base part connecting the arms. The latching pins 38 are integrally formed on the sides at the ends of the arms. The outer portion 22A is integrally formed on the base part. It contains a plate-like base part that is offset downwards toward the housing base 36 from the inner portion 22B so that the rear end side of the base part forms a step or a stop. The latching elements 44, which have run-in slopes, are integrally formed on the underside of the base part, facing away from the housing base 36. The height of the latching elements 44 is here dimensioned such that its lower limiting side is essentially aligned with the underside of the inner portion 22B and so do not protrude. The terms "upwards" and "downwards", and "top" and "underside" all refer to the orientation of the connector element shown in FIGS. 1 and 2. "Upwards" therefore refers to the direction toward the housing base 36 or the side facing the housing base 36, and "downwards" to the side facing away from the housing base 36.

The inner portion 22B also has a spring element 48, which is integrally formed and preferably configured as a type of elastic tab or spring tongue and is also arranged centrally on the base part of the support part 46 and in particular opposite the base part of the outer portion 22A. The spring element 48 is supported in the assembled state with its elastic spring force on the housing base 36 and thus pushes the latching elements 44 downwards toward the outside of the housing of the plug-in part 14 and thus into a locking position which simultaneously defines a base position.

The arms of the support part 46 and the base part are also connected together via struts in such a way that recesses 50 are formed into which the pull tab 20 engages in order to actuate the locking element 22. Each inner edge side of the recesses 50 forms a counteracting surface 52A with which the pull tab 20 interacts. In the exemplary embodiment, they are configured as approximately cylindrically curved surfaces. The counteracting surfaces 52A hereby in particular run parallel to the axis of rotation 42.

The locking element 22 according to the second exemplary embodiment shown in FIGS. 7A to 7D is in contrast configured in two parts as two separate components 22A, 22B. The two parts are here preferably positively connected together via a pin connection. The outer portion 22A is in particular made from metal, the inner portion 22B is preferably made from plastic. The rest of the structure of the locking element 22 is the same in both alternative embodiments.

Figure 4B:
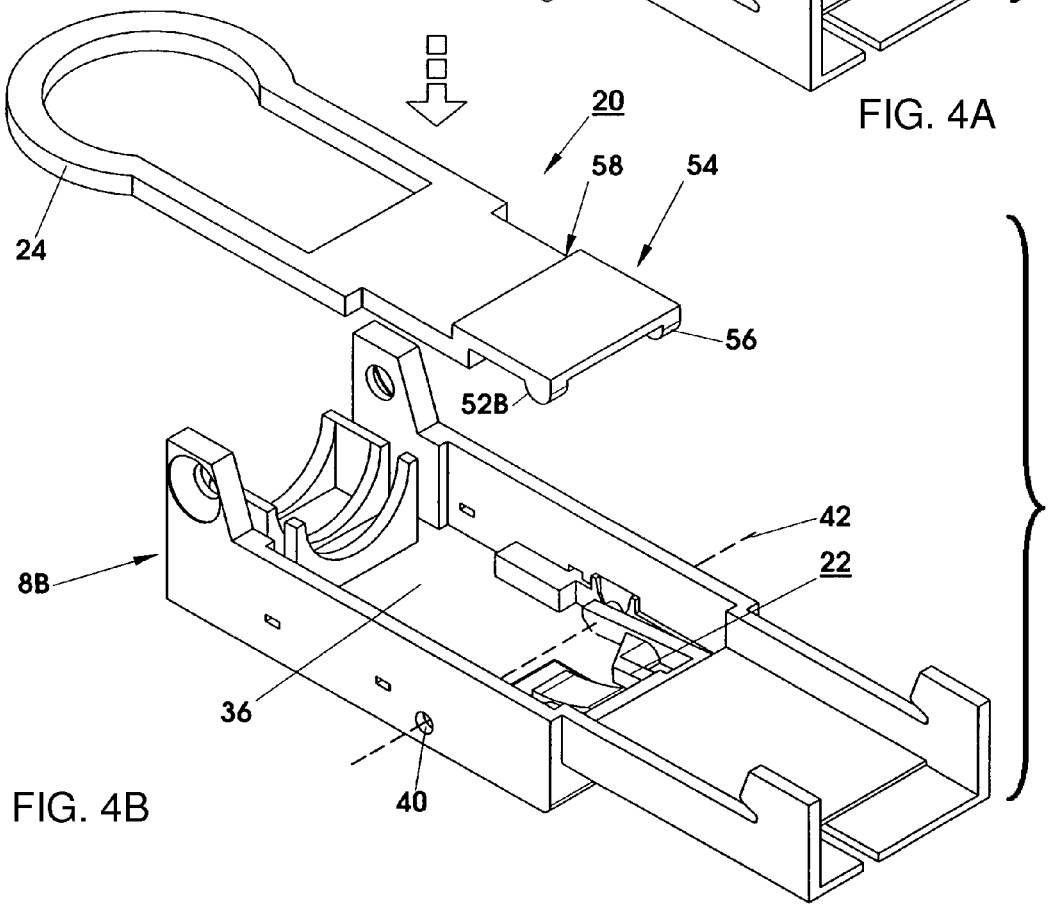
Figure 7B:
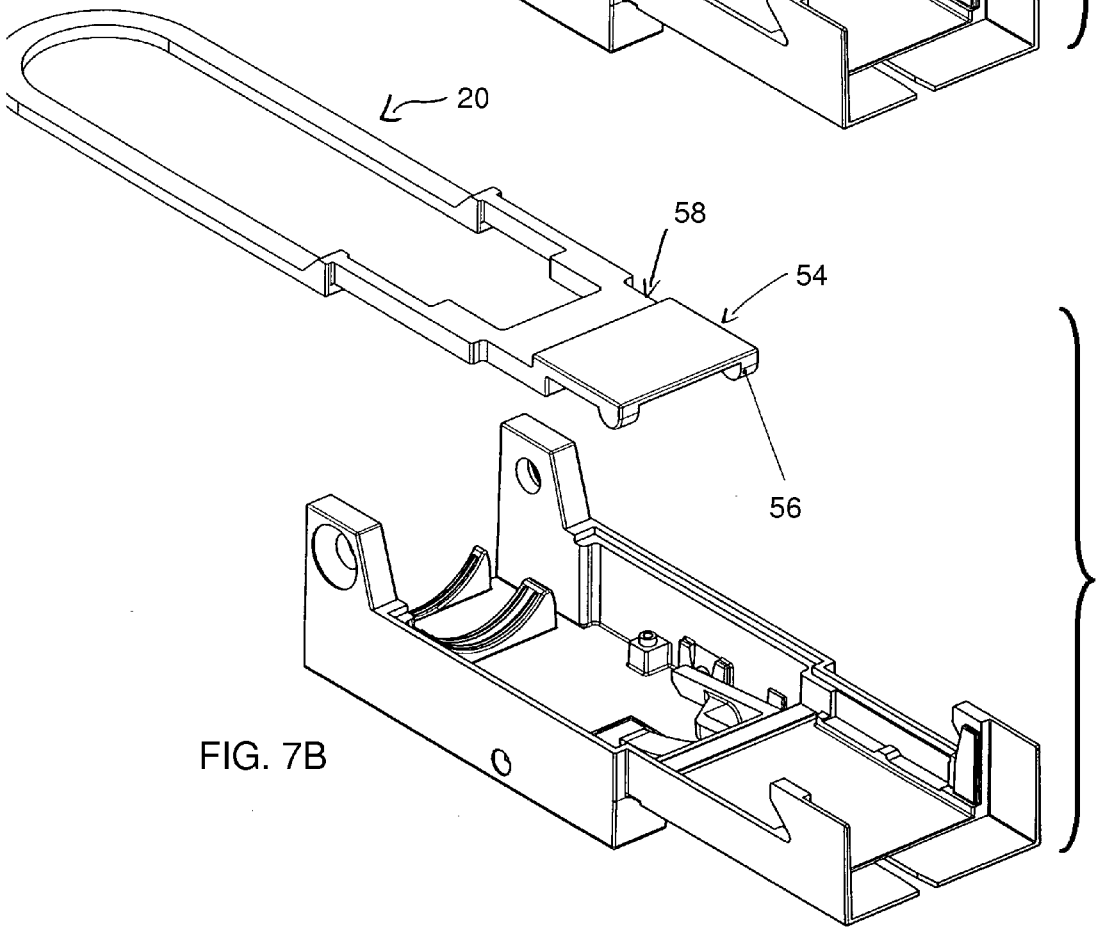

In the second assembly step shown in FIGS. 4B and 7B, the pull tab 20 is inserted. In the exemplary embodiment, the handle part 24 is configured as a handle ring which adjoins two lateral limbs that enclose a free space between them. These limbs pass through the first apertures 28. A more or less plate-like solid internal part, which is narrower than the limbs, adjoins the limbs internally. At its end, the pull tab 20 has a stepped plate-like region 54, at the end of which two actuating knobs 56 are integrally formed. The pull tab 20 is preferably configured as a single piece, preferably a plastic injection-molded part. The pull tab 20 covers the locking element 22 with the stepped region 54, the actuating knobs 56 engaging in the recesses 50. The actuating knobs 56 form counteracting surfaces 52B that correspond with the counteracting surfaces 52A. Because of the reduced width, the edge limbs of the support part 46 of the locking element 22 are not covered by the stepped region 54. These limbs can therefore perform a pivoting movement laterally between the side walls of the housing and the stepped region 54.

As a result of the stepped configuration of the inner region of the pull tab 20, a free space, in which the inner portion 22B can be accommodated, is formed on the top of the stepped region 54. The remainder of the pull tab 20 rests directly on the housing base 36 and is therefore supported against it. As a result of the stepped formation of the region 54, an edge or stop surface 58 is formed on the underside facing away from the housing base 36.

Figure 4C:
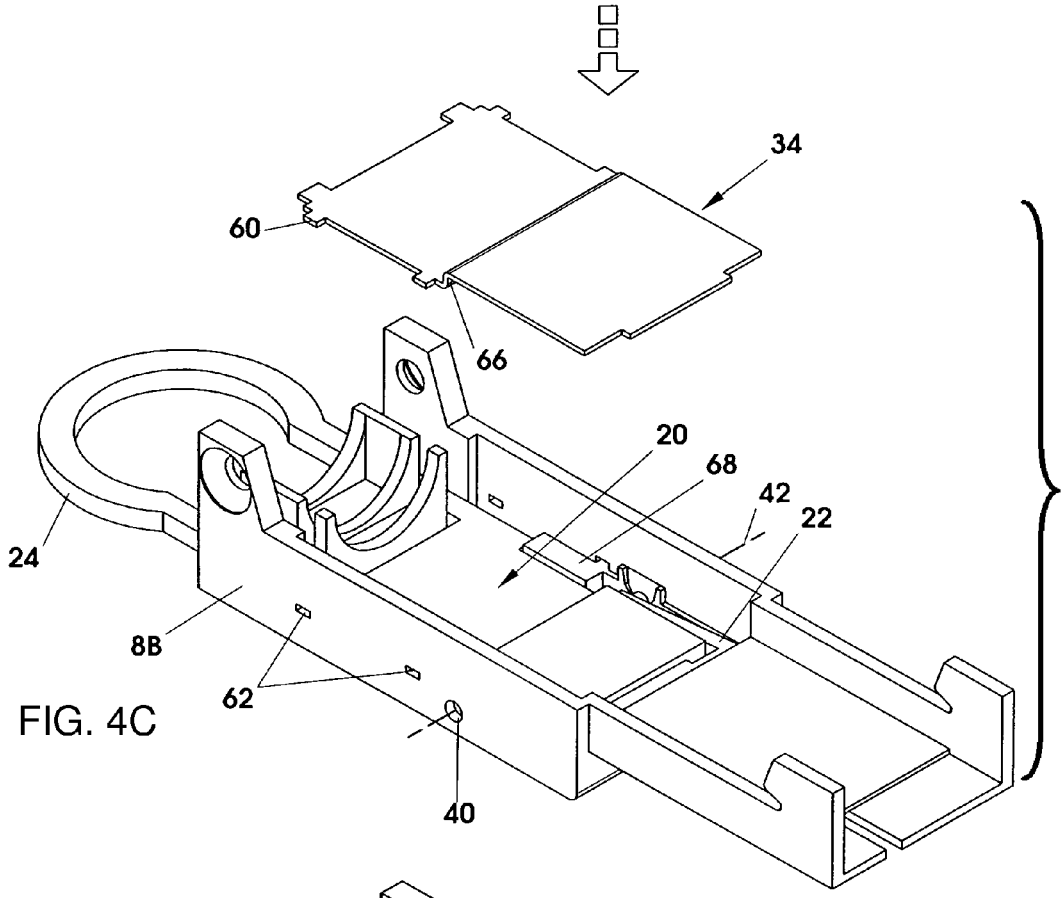
Figure 7C:
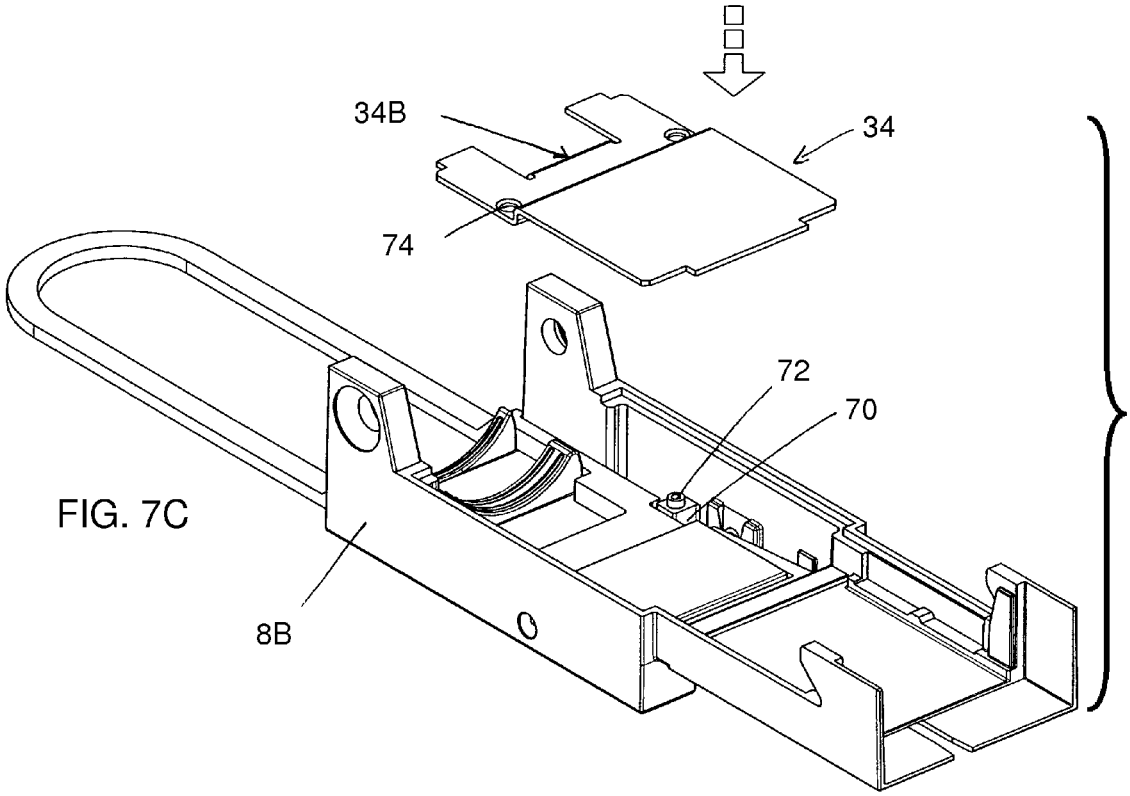
Figure 7D:
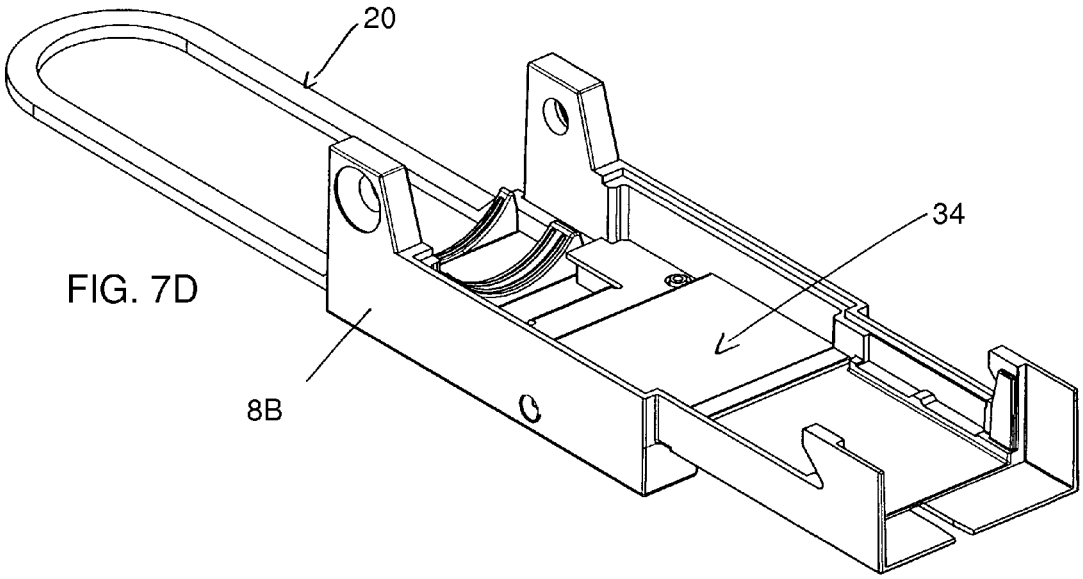

In the third assembly step shown in FIGS. 4C and 7C, the intermediate base 34 is inserted and fixed to the housing 8. To do this, in the exemplary embodiment, it has laterally protruding fixing elements 60 that engage in associated fixing openings 62 in the side walls of the upper housing part 8B and, in the final assembled state, engage underneath them in particular in a positive fashion. The fixing elements 60 are preferably configured as rivet elements. They can alternatively also be configured as latching elements.

According to the alternative embodiment shown in FIGS. 7A to 7D, the intermediate base 34 is riveted to the housing base 36. To do this, the intermediate base 34 preferably rests on spacers 70 which are, for example, configured as spacer sleeves and are preferably parts of the housing part 8B. The spacers 70 each have, on their upper end side forming a bearing surface for the intermediate base 34, a positioning element 72, in particular a positioning sleeve, that is inserted into a corresponding opening 74 in the intermediate base so that it fits exactly. A separate rivet element may be used for the riveting or the positioning element forms the rivet element, by the end edge of the positioning sleeve being formed in a riveting procedure so that it engages underneath the opening edge of the opening in the intermediate base 34.

The intermediate base 34 therefore acts as a partition base that divides the interior of the housing 8 so that the pull tab 20 and the locking element 22 are arranged in a separate subspace. At the same time, the intermediate base 34 acts in the manner of a fixing plate and serves to securely fix and guide the pull tab 20 and the locking element 22. The pull tab 20 therefore slides, guided by the housing base 36 and the intermediate base 34, between these two elements. At the same time, the intermediate base 34 forms a counter bearing on which the pull tab 20, in particular the stepped region 54, can be supported so that the necessary counter forces for actuating the locking element 22 (actuation counter to the spring force of the spring element 48) can be exerted.

The intermediate base 34 itself has a more or less Z-shaped configuration when viewed from the side and possesses a step that forms a stop 66 for the stop surface 58 of the pull tab 20, in order to limit the backward movement of the pull tab 20. In order to limit the movement of the pull tab 20 in the opposite direction, stop elements 68, against which abut the outwardly projecting limbs of the pull tab 20 which go on to form the handle part 24, are arranged on the side walls of the upper housing part 8B.

In the second exemplary embodiment, the pull tab 20 is modified in such a way that it has respective dual stops, preferably for movement both backwards and forwards. In order to limit the forward movement, the pull tab 20 thus has on its side bars two longitudinally offset pairs of stops which are formed by steps. The rear pair of stops hereby interacts with the outer wall of the housing. For the backward movement, an additional transverse stop is provided between the side bars which interacts with a discontinuity 34A (folded edge) of the intermediate base 34 (see in particular FIG. 7C, folded edge at the bottom).

Figure 4D:
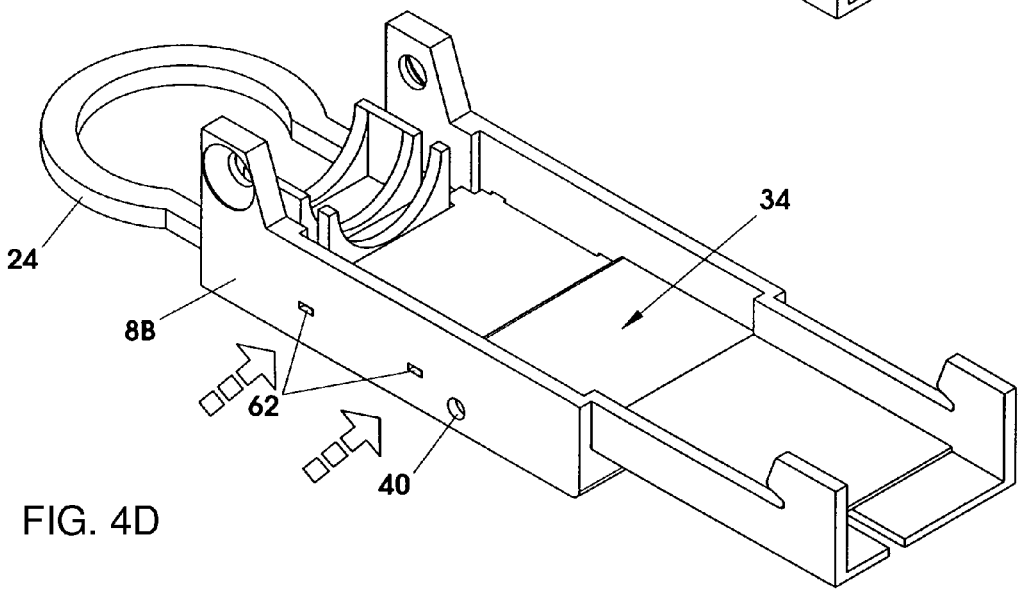

FIG. 4D shows the assembled state. In the exemplary embodiment, only latching or snap-in connections are provided in order to form the locking mechanism, so that the connector can be assembled simply and without the use of tools. In a preferred embodiment, a rivet connection is alternatively provided. Integrating the locking mechanism inside the housing 8 additionally allows relatively simple assembly because it is possible to simply place it inside the housing. In the exemplary embodiment, the locking mechanism consists solely of the three components: the pull tab 20, the locking element 22 and the intermediate base 34, interacting with the upper housing part 8B.

The mode of functioning of the locking mechanism will now be described below with the aid of FIGS. 5A, 5B, 6A and 6B.

Figure 5A:
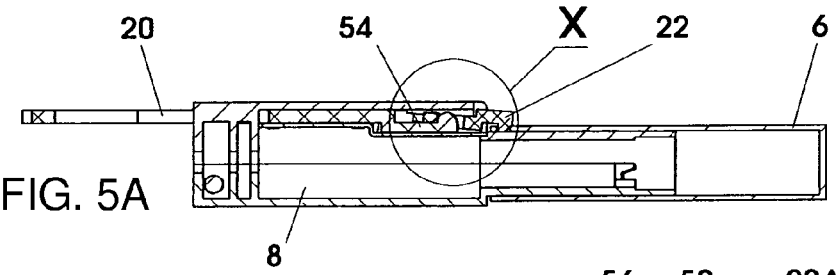
FIG. 5A is a longitudinal sectional view through a plug connection similar to FIG. 2 in a locked position.
Figure 5B:
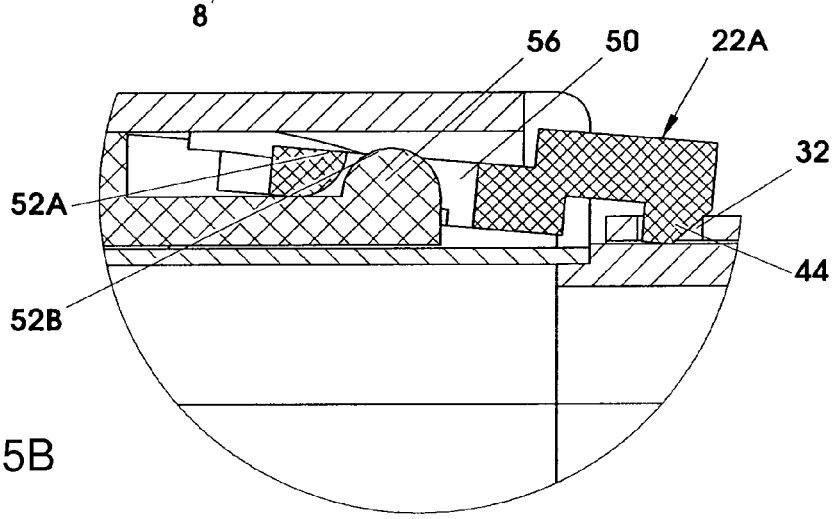
FIG. 5B is an enlarged, longitudinal sectional view of a circled detail X shown in FIG. 5A.
Figure 6A:
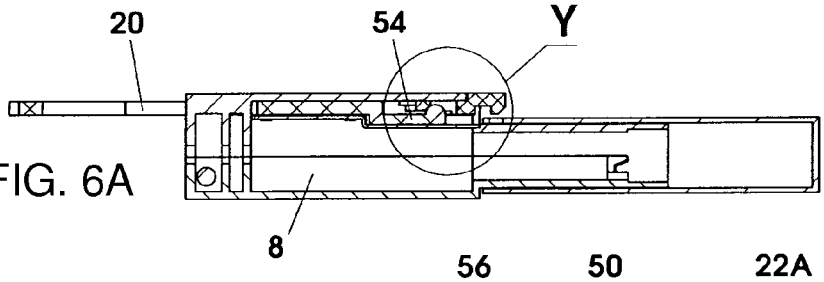
FIG. 6A is a longitudinal sectional view as in FIG. 5A but in an unlocked position.
Figure 6B:
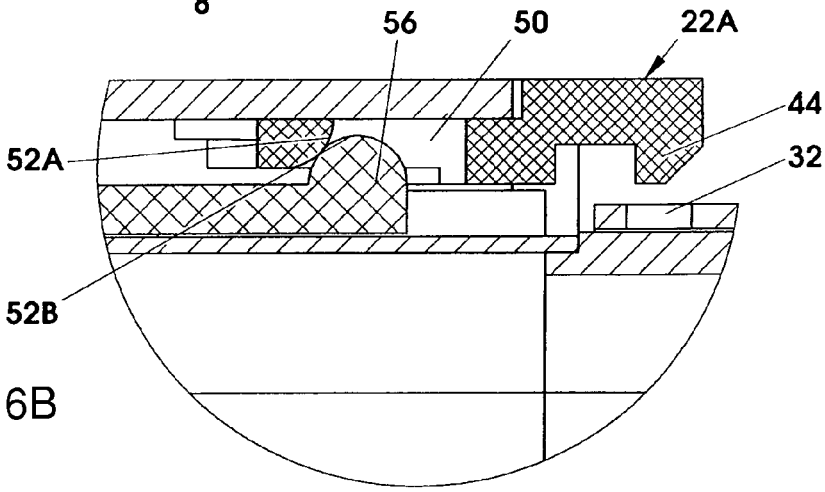
FIG. 6B is an enlarged, longitudinal sectional view of a circled detail Y in FIG. 6A.

The base position corresponds to the locked position shown in FIG. 5B. The outer portion 22A and thus the latching elements 44 are pushed downwards by the spring element 48, so that the latching elements 44 engage into the latching receptacles 32 of the mating piece 6.

In order to unlock the connector, the pull tab 20 is pulled backwards by hand. The two counteracting surfaces 52A, 52B thus interact and slide on each other. Because the pull tab 20 is supported on the intermediate base 34, a resulting force perpendicularly upwards is created so that the locking element 22 exerts a rotational movement about the axis of rotation 42, counter to the spring force of the spring element 48, and the latching elements 44 are guided upwards in an arc from the latching receptacles 32 and the locking is canceled.

In order to lock the connector, the pull tab 20 is shifted forwards again so that the latching elements 44 are pushed downwards again by the spring force of the spring element 48. The shifting of the pull tab 20 forwards is here at least supported by the spring force. The spring force is preferably sufficient to automatically shift the pull tab 20 forwards into the locked position.

The invention claimed is:

1. A connector element having a locking mechanism for forming a lockable plug connection with a mating piece, the connector element comprising:

a housing extending in a longitudinal direction and having a housing base;

a counter bearing disposed in said housing and being a separate intermediate base;

a locking element having a latching element for latching to the mating piece; and an actuating element having a handle part for actuating said locking element, said actuating element and said locking element disposed inside of said housing, said housing having a first aperture formed therein for said actuating element, through which said actuating element passes, so that said handle part being accessible from outside said housing;

said locking element and said actuating element disposed between said housing base and said counter bearing.

2. The connector element according to claim 1, wherein said housing having a second aperture formed therein for said locking element, and that an outer portion of said locking element, which has said latching element, is guided to the outside through said second aperture.

3. The connector element according to claim 1, wherein said locking element is mounted rotatably about an axis of rotation in said housing.

4. The connector element according to claim 1, wherein said locking element has lateral latching pins, via which said locking element can be rotatably latched in said housing.

5. The connector element according to claim 1, wherein said locking element has a spring element that pushes said locking element into a base position.

6. The connector element according to claim 1, wherein:

said actuating element has an actuating knob; and said locking element has at least one recess formed therein, into said recess said actuating element engages via said actuating knob, and in that said recess and said actuating knob interact via counteracting surfaces which correspond with each other.

7. The connector element according to claim 1, wherein said actuating element has a stepped region that covers an inner portion of said locking element disposed inside of said housing.

8. The connector element according to claim 1, wherein said locking element is formed as a one piece element.

9. The connector element according to claim 1, wherein said locking element contains an inner portion, situated inside of said housing, and an outer portion, said inner portion having a U-shaped support part with a base part and arms connected to said base part, latching pins for rotatable fastening in said housing being integrally formed at ends of said arms and a spring element being integrally formed on said base part.

10. The connector element according to claim 1, wherein said intermediate base is conductive for electrical shielding.

11. The connector element according to claim 1, wherein:

said actuating element has a stop surface; and said intermediate base having a stop, in order to actuate a movement of said actuating element on said intermediate base, said stop interacts with said stop surface of said actuating element.

12. The connector element according to claim 2, wherein said housing has a front stepped plug-in part and a rear housing part adjoining said front stepped plug-in part, forming a step at said adjoining, and in that said second aperture is formed on said step.

13. The connector element according to claim 6, wherein said counteracting surfaces are cylindrical shaped.

14. The connector element according to claim 1, wherein said counter bearing is one of riveted or latched fixedly in said housing.

* * * * *